US010458292B2

(12) United States Patent
Hoglund

(10) Patent No.: US 10,458,292 B2
(45) Date of Patent: Oct. 29, 2019

(54) GAS EXCHANGE VALVE ACTUATOR FOR AXIAL DISPLACEMENT OF A GAS EXCHANGE VALVE OF A COMBUSTION ENGINE

(71) Applicant: Freevalve AB, Angelholm (SE)

(72) Inventor: Anders Hoglund, Munka Ljungby (SE)

(73) Assignee: FREEVALVE AB, Angelholm (SE)

( * ) Notice: Subject to any disclaimer, the term of this patent is extended or adjusted under 35 U.S.C. 154(b) by 742 days.

(21) Appl. No.: 14/877,463

(22) Filed: Oct. 7, 2015

(65) Prior Publication Data

US 2016/0108777 A1 Apr. 21, 2016

(30) Foreign Application Priority Data

Oct. 15, 2014 (SE) ..... 1451233

(51) Int. Cl.
*F01L 9/02* (2006.01)
*F01L 1/46* (2006.01)

(52) U.S. Cl.
CPC ..... *F01L 9/023* (2013.01); *F01L 1/462* (2013.01); *F01L 9/026* (2013.01)

(58) Field of Classification Search
CPC ... F01L 9/02; F01L 9/026; F01L 9/021; F01L 9/023; F01L 9/025; F01L 9/04; F01L 1/462; F01L 1/465; F15B 15/149
USPC ..... 123/90.12, 90.14
See application file for complete search history.

(56) References Cited

U.S. PATENT DOCUMENTS 2,580,751 A 1/1952 Fletcher
4,484,545 A * 11/1984 Madsen ..... F01L 9/02 123/90.12
5,193,495 A * 3/1993 Wood, III ..... F01L 9/02 123/90.12

(Continued)

FOREIGN PATENT DOCUMENTS

EP 0 377 251 A1 7/1990
GB 768 502 A 2/1957
WO 2014/007727 A1 1/2014

OTHER PUBLICATIONS

Extended European Search Report, dated Feb. 23, 2016, from corresponding European application.

(Continued)

*Primary Examiner* — Phutthiwat Wongwian
*Assistant Examiner* — Loren C Edwards
(74) *Attorney, Agent, or Firm* — Young & Thompson

(57) ABSTRACT

An actuator for axial displacement of a gas exchange valve of a combustion engine is configured to be connected to a pressure fluid source and a pressure fluid sink, respectively, and to be driven by a gaseous pressure fluid and includes an actuator piston including an actuator piston disc and an actuator piston rod projecting therefrom in the axial direction, a cylinder volume, the disc separating the cylinder volume into a first part and a second part and being displaceable back and forth in the axial direction in the cylinder volume between an inactive position and an active position, the first part being configured for controllable fluid communication with the pressure fluid source and the pressure fluid sink, respectively, and a hydraulic circuit includes a chamber, the free end of the rod being arranged therein, wherein the rod is displaceable back and forth in the axial direction in a channel.

12 Claims, 2 Drawing Sheets

(56) References Cited

U.S. PATENT DOCUMENTS

2009/0145393 A1 6/2009 Sakata

OTHER PUBLICATIONS

Swedish Office Action, dated May 13, 2015; Application No. 1451233-9.

* cited by examiner

GAS EXCHANGE VALVE ACTUATOR FOR AXIAL DISPLACEMENT OF A GAS EXCHANGE VALVE OF A COMBUSTION ENGINE

TECHNICAL FIELD OF THE INVENTION

The present invention relates to a gas exchange valve actuator for axial displacement of a gas exchange valve of a combustion engine. Thus, the present invention is particularly usable in applications having demand for high speeds and precise controllability of the axial displaceability, as well as demand for low operational noise levels. The present invention relates in particular to an actuator for axial displacement of at least one gas exchange valve of a combustion engine, wherein the actuator is proposed to operate/manipulate one or more inlet valves or outlet valves controlling the supply and evacuation, respectively, of air/gas in relation to the cylinder of the combustion engine. The inventive actuator is thus especially suitable for operating/controlling engine valves and thereby eliminates the need for one or more cam shafts in the combustion engine. The present invention also relates to a combustion engine comprising such a gas exchange valve actuator.

The inventive gas exchange valve actuator is configured to be connected to a pressure fluid source (HP) and a pressure fluid sink (LP), respectively, and is configured to be driven by a gaseous pressure fluid and comprises an actuator piston, a cylinder volume and a hydraulic circuit. The actuator piston comprises an actuator piston disc and an actuator piston rod projecting/extending from the actuator piston disc in the axial direction, the actuator piston disc dividing/separating said cylinder volume in a first part and a second part and being displaceable back and forth in the axial direction in said cylinder volume between an inactive position and an active position, the first part of the cylinder volume being configured for controllable fluid communication with said pressure fluid source (HP) and said pressure fluid sink (LP), respectively, and the actuator piston being biased in the direction from the second part of the cylinder volume towards the first part of the cylinder volume, and the hydraulic circuit comprises a chamber, the free end of the actuator piston rod being arranged in said chamber, wherein the actuator piston rod is displaceable back and forth in the axial direction in a channel in connection with axial displacement of the actuator piston disc in the cylinder volume, said channel extending between the first part of the cylinder volume and the chamber of the hydraulic circuit.

BACKGROUND OF THE INVENTION AND PRIOR ART

Such an actuator, also known as a pneumatic actuator, comprises an actuator piston disc that is displaceable in the axial direction between a first position (rest position) and a second position (active/extended position). The displacement is obtained by controlling the supply of a gaseous pressure fluid, such as compressed gas/air, acting against the actuator piston disc. The actuator piston disc act in its turn directly or indirectly against the object that shall be displaced, i.e. the engine valve/gas exchange valve, in order to control the position thereof.

When the actuator piston disc is in the rest position the engine valve is in contact with its seat, and when the actuator piston disc is in the active position the engine valve is open, i.e. located at a distance from its seat. It is known that the actuator in some applications demand for high work pressure/high pressure, for instance in the range 8-30 bar, in order to obtain correct function, i.e. be able to operate together with a combustion engine having a range of revolution amounting to 8-10 thousand revolutions per minute. Thereto it is important in some applications to avoid that the temperature in the actuator and in surrounding details/fluids increases due to the actual operation of the actuator and the accompanying compressor, and this is attained by keeping the pressure ratio at a low level and thereby a so-called increased return pressure is utilized, also know as low pressure/basic pressure. In other words, the pressure of the pressure fluid located downstream the actuator is much higher than the atmospheric pressure, for instance 3-6 bar.

The valve actuator makes use of pneumatics as well as hydraulics for the operation thereof, and in valve actuator solutions the risk of mixing gas and hydraulic liquid is high due to the sealings between the different fluids not being hundred percent fluid tight and after some time it is a risk that the fluids may have negative effect to each other. The great pressure fluid pressures entail that the gaseous pressure fluid, continuously or during pressure peaks, risk to be pressed along the actuator piston rod in the direction towards and into the chamber of the hydraulic circuit, resulting in gas contamination of the hydraulic liquid. A gas contamination of the hydraulic liquid lead to great deterioration of the properties of the hydraulic liquid.

Objects of the Invention

The present invention aims at obviating the aforementioned disadvantages and failings of previously known gas exchange valve actuators and at providing an improved actuator. A primary object of the invention is to provide an improved gas exchange valve actuator of the initially defined type which eliminates gas contamination if the hydraulic liquid.

SUMMARY OF THE INVENTION

According to the invention at least the primary object is attained by means of the initially defined gas exchange valve actuator having the features defined in the independent claims. Preferred embodiments of the present invention are further defined in the dependent claims.

According to the present invention there is provided an actuator of the initially defined type, which is characterized in that the channel extending between the first part of the cylinder volume and the chamber of the hydraulic circuit comprises at least one circumferential ventilation groove that is configured to be connected to said pressure fluid sink.

Thus, the present invention is based on the insight that by preventing gas contamination of the hydraulic liquid an actuator more reliable in service over time is obtained.

According to a preferred embodiment of the present invention, the actuator comprises an inlet channel extending between a pressure fluid inlet and the first part of the cylinder volume and comprising an inlet valve body, an outlet channel extending between the first part of the cylinder volume and a pressure fluid outlet and comprising an outlet valve body, the pressure fluid inlet being configured to be connected to the pressure fluid source (HP) and the pressure fluid outlet being configured to be connected to the pressure fluid sink (LP).

Further advantages with and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF PREFERRED EMBODIMENTS

The present invention relates to an actuator, generally designated 1, for axial displacement of an object, especially a gas exchange valve actuator 1 for axial displacement of a gas exchange valve of a combustion engine. The invention will herein below be described with reference to the application in which the gas exchange valve actuator 1 is used to drive one or more inlet valves or outlet valves in a combustion engine.

Figure 1:
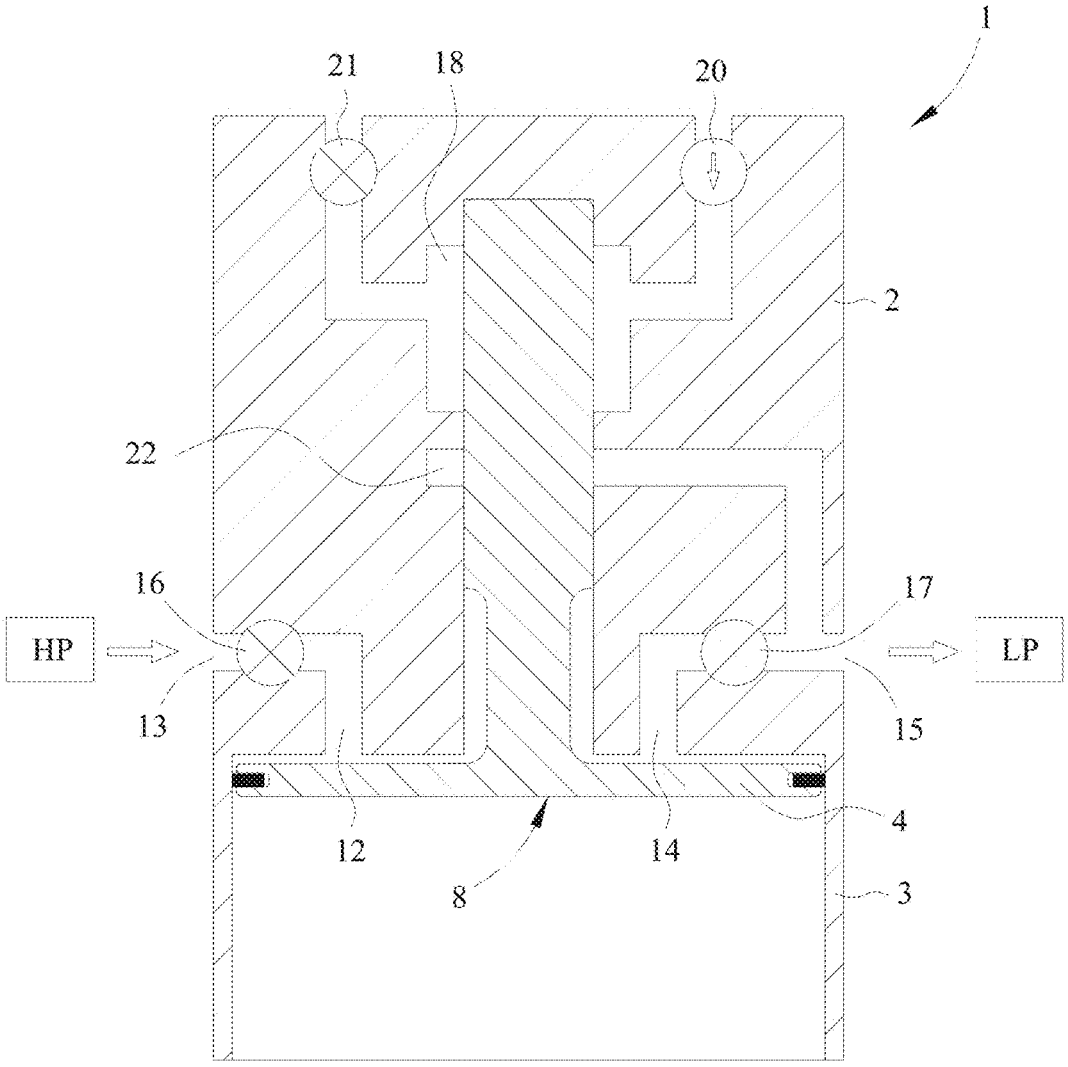
FIG. 1 is a schematic view from the side of an inventive gas exchange valve actuator, in which the actuator is in the inactive state thereof having the actuator piston disc in the inactive position.
Figure 2:
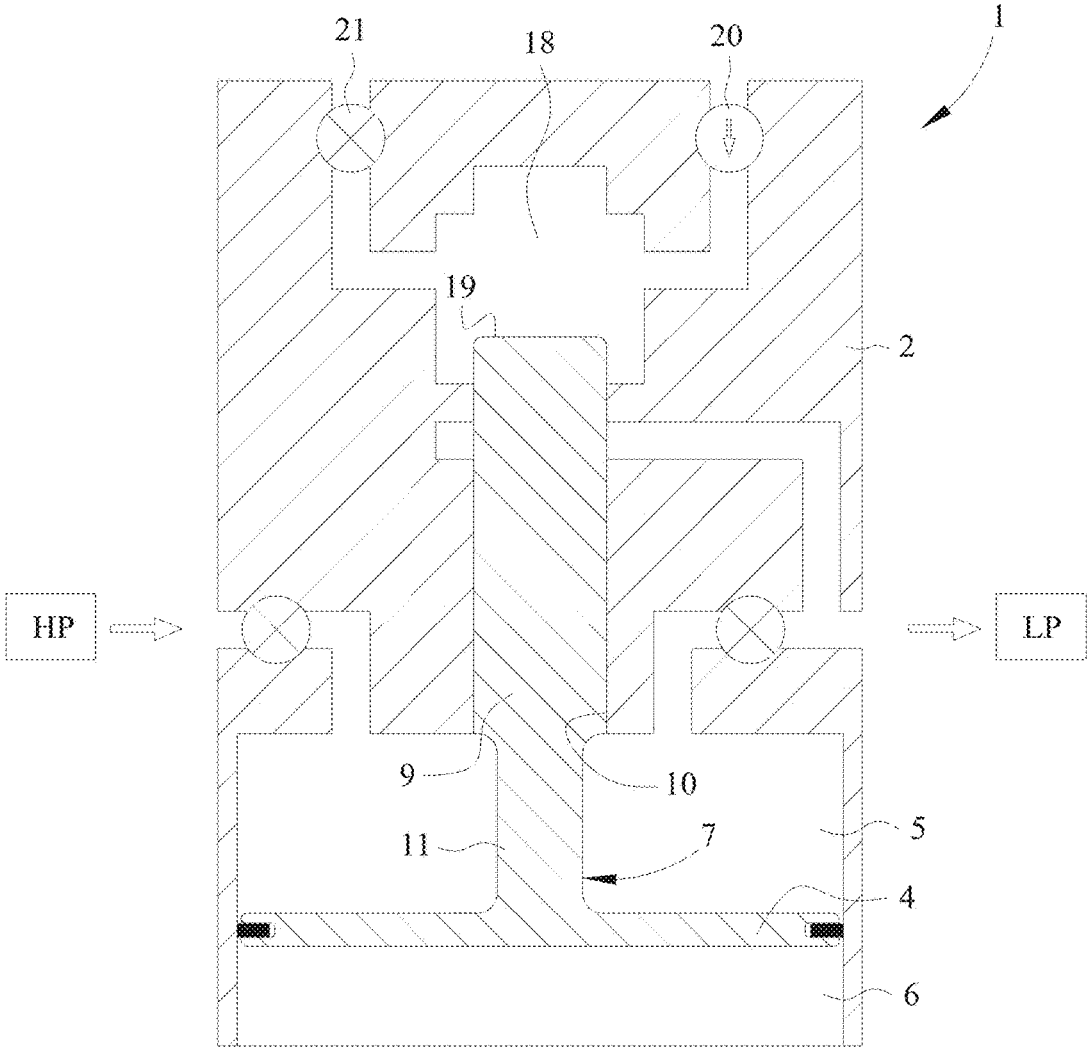
FIG. 2 is a schematic cross sectional view from the side corresponding to FIG. 1, in which the actuator piston rod is located in the active position.

In the disclosed embodiment the actuator 1 comprises an actuator housing 2, a cylinder 3 delimiting a cylinder volume, an actuator piston disc 4 that is arranged in and in the axial direction displaceable back and forth in said cylinder volume between an inactive rest position/upper dead centre (FIG. 1) and an active position/lower dead centre (FIG. 2). The actuator piston disc 4 separates said cylinder volume in a first, upper part 5 and a second, lower part 6. The valve stem of the gas exchange valve terminates in the second part 6 of the cylinder volume, and the gas exchange valve is biased in the direction upwards by means of a conventional valve spring or pneumatic spring (not shown). The actuator piston disc 4 is returned to the rest position thereof by being biased, preferably by means of the spring means, in the direction upwards. The spring means may be constituted by a mechanical spring or a pneumatic spring, located in the second part 6 of the cylinder volume. In the case the actuator piston is connected to and drives an inlet valve or an outlet valve of a combustion engine, the spring may be constituted by a valve spring lifting/returning the gas exchange valve to the closed position thereof. However, alternative solutions to realize the bias are conceivable and within the scope of the present invention.

Thereto the actuator 1 comprises an actuator piston rod, generally designated 7, that is fixedly connected to and axially projecting from the actuator piston disc 4, and that together with the actuator piston disc form an actuator piston 8. The actuator piston rod 7 eliminates the risk of tilting the actuator piston disc 4. The actuator piston rod 7 has in the disclosed embodiment a first, thick part 9, that is located at a distance from the actuator piston disc 4 and that is in tight-fit with a channel 10 in the actuator housing 2, and a second, narrow part 11 extending between and connecting the thick part 9 and the actuator piston disc 4. It shall be pointed out that the actuator piston rod 7 can be of uniform thickness along the entire length thereof and/or present one or more circumferential grooves configured to control different fluid flows as is previously known and will not be described further herein.

The actuator 1 also comprises a pneumatic pressure fluid circuit, configured for controllable supply of a gas or gas mixture, for instance air, from a pressure fluid source HP to the first part 5 of the cylinder volume in order to generate a displacement of the actuator piston disc 4 to the position shown in FIG. 2, and is configured for controllable evacuation of the gas or gas mixture from the first part 5 of the cylinder volume to a pressure fluid sink LP in order to generate a return movement of the actuator piston disc 4 to the position shown in FIG. 1. Thus, the pressure fluid is gaseous.

The pressure fluid circuit comprises an inlet channel 12 extending between a pressure fluid inlet 13 in the actuator housing 2 and the first part 5 of the cylinder volume, and an outlet channel 14 extending between the first part 5 of the cylinder volume to a pressure fluid outlet 15 in the actuator housing 2. Said inlet channel 12 is connected to the pressure fluid source HP via the pressure fluid inlet 13, and said outlet channel 14 is connected to the pressure fluid sink LP via the pressure fluid outlet 15. In other words, the pressure fluid inlet 13 of the actuator 1 is configured to be connected to the pressure fluid source HP, and the pressure fluid outlet 15 is configured to be connected to the pressure fluid sink LP. The pressure fluid source can be constituted by a compressor belonging to the engine and may comprise a tank, or be constituted by solely a pressure tank. The pressure fluid sink can be constituted by any place having a lower pressure than is generated in the pressure fluid source, for instance a conduit extending back to the compressor. The pressure fluid circuit is preferably a closed system having an increased return pressure, i.e. the pressure fluid sink LP has for instance 3-6 bar pressure, and the pressure fluid source HP has for instance 8-30 bar pressure.

The actuator 1 comprises, according to the disclosed embodiment, an inlet valve body 16 arranged in said inlet channel 12 in order to control the flow of pressure fluid in the inlet channel 12 past the position at which the inlet valve body 16 is located, i.e. configured to open and close, respectively, the inlet channel 12. The inlet valve body 16 is preferably biased by means of a spring in a direction closing the inlet channel 12.

The actuator 1 comprises an outlet valve body 17 arranged in said outlet channel 14 in order to control the flow of pressure fluid in the outlet channel 14 past the position at which the outlet valve body 17 is located, i.e. configured to open and close, respectively, the outlet channel 14. The outlet valve body 17 is preferably biased by means of a spring in a direction opening the outlet channel 14. The inlet valve body 16 and the outlet valve body 17 are controlled in any suitable way, for instance by means of direct or indirect electrically control, by means of a not disclosed electrical controlled pilot valve. The term direct electrically controlled mean that the position of the valve is directly controlled by for instance an electro magnetic device, and indirect electrically controlled mean that the position of the valve is controlled by a pressure fluid that in its turn is controlled by for instance an electro magnetic device/pilot valve, such as a solenoid, or by means of a piezoelectric device, etc.

According to one embodiment the inlet valve body 16 and the outlet valve body 17 are connected to each other. Thus, the valve bodies move jointly with each other at activation, whereupon the inlet channel 12 is closed when the outlet channel 14 is open and vice versa. Also other known combinations/constellations of the disclosed valve bodies and other valve bodies are conceivable in order to fill and empty, respectively, the first part 5 of the cylinder volume, also known as for instance cutting pin. These are not described herein.

It shall be pointed out that the valves in the actuator 1 are schematically disclosed and may for instance be constituted by slide valves, seat valves, etc. Thereto several of said controllable valves may be constituted by a single body.

Thereto the actuator 1 comprises a hydraulic circuit comprising a chamber 18, the free end 19 of the actuator piston rod 7 being arranged to be displaced in the axial direction in relation to said chamber 18 in connection with axial displacement of the actuator piston disc 4 in the cylinder volume.

Hydraulic liquid (oil) is allowed to flow into the chamber 18 via a check valve 20 and out of the chamber 18 via a hydraulic valve 21. The hydraulic valve 21 comprises a hydraulic valve body that is displaceable back and forth between a closed position/rest position and an open/active position, wherein the hydraulic valve body is biased by means of a spring in the direction away from the closed position. In other words, when the actuator valve 8 is displaced from the rest position (FIG. 1) to the active position (FIG. 2) the actuator piston rod 7 leave room for inflow of liquid into the chamber 18 and the hydraulic valve is closed, and when the actuator piston 8 is displaced from the active position to the rest position the hydraulic valve must first be opened whereupon liquid is pressed out of the chamber 18. The hydraulic valve body can be connected to the inlet valve body 16 and/or the outlet valve body 17, whereupon the connected valve bodies are moved jointly with each other.

The actuator piston rod 7 of the actuator piston 8 is displaceable back and forth in the axial direction in the channel 10 of the actuator housing 2 in connection with axial displacement of the actuator piston disc 4 in the cylinder volume, said channel 10 extending between the first part 5 of the cylinder volume and the chamber 18 of the hydraulic circuit. The channel 10 comprises at least one circumferential ventilation groove 22 that is configured to be connected to said pressure fluid sink LP. The ventilation groove 22 is preferably connected to the outlet channel 14 downstream the outlet valve body 17, and upstream the pressure fluid outlet 15. The ventilation groove 22 result in that the pressure fluid in the first part 5 of the cylinder volume, that continuously or intermittently can present higher pressure than the hydraulic liquid in the chamber 18, is prevented from being pressed up along the channel 10 into the chamber 18 and is ventilated via the ventilation groove 22. Thereby it is ensured that no gas contamination of the hydraulic liquid can occur. A little controlled leakage of hydraulic liquid that is pressed from the chamber 18 along the channel 10 and into the ventilation groove 22 is allowed, and also favorable, as hydraulic liquid mist in the gaseous pressure fluid assist in lubricating the components of the actuator 1.

In FIG. 1 the actuator 1 is disclosed in the rest position thereof. This entail that the actuator piston disc 4 is in the rest position/upper dead centre, the inlet valve body 16 is in the closed position and the outlet valve body 17 is open or closed.

When a signal is given, for instance by a control unit, that the actuator 1 shall perform a displacement of the object/engine valve, the inlet valve body 16 is open, it shall be pointed out that first it is ensures that the outlet channel 14 is closed. Pressure fluid flow into the first part 5 of the cylinder volume via the inlet channel 12 and act against the upper side of the actuator piston disc 4 and displace the actuator piston 8 in the direction downwards. The outlet valve body 17 is kept closed. When the actuator piston disc 4 has been displaced a predetermined distance the inlet channel 12 is closed, i.e. continued inflow of pressure fluid from the pressure fluid source HP to the first part 5 of the cylinder volume is prevented, whereupon the actuator piston disc 4 continues its displacement and takes the active position/lower dead centre thereof, as is seen in FIG. 2. The actuator piston disc 4 continues its displacement downwards after the inflow to the first part 5 of the cylinder volume is closed, since the gas in the first part 5 of the cylinder volume expand and compress the valve spring of the engine valve. The pressure level in the pressure fluid source HP is known, the size of the volume of the first part 5 of the cylinder volume when the inlet channel 12 is closed is known, the power characteristic of the valve spring is known, etc. thereby the length of the continued displacement of the actuator piston disc 4 can be controlled with good precision.

In order to admit return movement of the actuator piston disc 4 the inlet channel 12 is closed, whereupon the outlet channel 14 is opened, and the actuator piston disc 4 is displaced upwards by for instance the valve spring whereupon the pressure fluid in the first part 5 of the cylinder volume is evacuated through the outlet channel 14. Thereby the actuator 1 is back in the rest state as shown in FIG. 1. The actuator piston disc 4 is returned to its rest position, by means of a biased spring member, in the direction upwards. The spring member can be constituted by a mechanical spring or a pneumatic spring, located in the second part 6 of the cylinder volume. In the embodiment the actuator piston is connected to and drives an inlet or outlet valve of a combustion engine the spring may be constituted by a valve spring lifting the gas exchange valve to the closed position thereof. Alternative solutions how to realize this bias are conceivable and within the scope of the present invention.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus, the equipment may be modified in all kinds of ways within the scope of the appended claims.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

The invention claimed is:

1. A gas exchange valve actuator for axial displacement of a gas exchange valve of a combustion engine, the actuator being configured to be connected to a pressure fluid source and a pressure fluid sink, respectively, and being configured to be driven by a gaseous pressure fluid, the actuator comprising:

an actuator piston comprising an actuator piston disc and an actuator piston rod projecting from the actuator piston disc in an axial direction;

a cylinder volume, the actuator piston disc separating said cylinder volume in a first part and a second part and being displaceable back and forth in the axial direction in said cylinder volume between an inactive position and an active position, the first part of the cylinder volume being configured for controllable fluid communication with said pressure fluid source and said pressure fluid sink, respectively, the actuator piston being biased in a direction from the second part of the cylinder volume towards the first part of the cylinder volume; and a hydraulic circuit comprising a chamber, a free end of the actuator piston rod being disposed in said chamber, wherein the actuator piston rod is displaceable back and forth in the axial direction in a channel in connection with axial displacement of the actuator piston disc in the cylinder volume, said channel extending between the first part of the cylinder volume and the chamber of the hydraulic circuit, and wherein said channel comprises at least one circumferential ventilation groove that is configured to be constantly connected to said pressure fluid sink.

2. The gas exchange valve actuator according to claim 1, further comprising:

an inlet channel extending between a pressure fluid inlet to the first part of the cylinder volume and comprising an inlet valve body; and an outlet channel extending between the first part of the cylinder volume to a pressure fluid outlet and comprising an outlet valve body, wherein the pressure fluid inlet is configured to be connected to the pressure fluid source and the pressure fluid outlet is configured to be connected to the pressure fluid sink.

3. The gas exchange valve actuator according to claim 2, wherein the inlet valve body is biased by a spring in a direction closing the inlet channel.

4. The gas exchange valve actuator according to claim 3, wherein the ventilation groove is connected to the outlet channel downstream the outlet valve body.

5. The gas exchange valve actuator according to claim 2, wherein the ventilation groove is connected to the outlet channel downstream the outlet valve body.

6. The gas exchange valve actuator according to claim 2, wherein the hydraulic circuit comprises said chamber, a check valve configured to admit a flow of hydraulic liquid to the chamber, and a hydraulic valve configured to control a flow of hydraulic liquid from the chamber.

7. The gas exchange valve actuator according to claim 6, wherein the hydraulic valve comprises a hydraulic valve body that is displaceable back and forth between a closed position and an open position, the hydraulic valve body being biased by a spring in the direction away from the closed position thereof.

8. The gas exchange valve actuator according to claim 7, wherein the inlet valve body and the hydraulic valve body are connected to each other.

9. The gas exchange valve actuator according to claim 1, wherein the actuator piston rod is fixedly connected to the actuator piston disc.

10. The gas exchange valve actuator according to claim 1, wherein the hydraulic circuit comprises said chamber, a check valve configured to admit a flow of hydraulic liquid to the chamber, and a hydraulic valve configured to control a flow of hydraulic liquid from the chamber.

11. The gas exchange valve actuator according to claim 10, wherein the hydraulic valve comprises a hydraulic valve body that is displaceable back and forth between a closed position and an open position, the hydraulic valve body being biased by a spring in the direction away from the closed position thereof.

12. A combustion engine comprising:

a gas exchange valve;

a gas exchange valve actuator configured for axial displacement of said gas exchange valve;

a pressure fluid source; and a pressure fluid sink, the actuator being connected to the pressure fluid source and the pressure fluid sink, respectively, and being configured to be driven by a gaseous pressure fluid, the actuator comprising:

an actuator piston comprising an actuator piston disc and an actuator piston rod projecting from the actuator piston disc in an axial direction, a cylinder volume, the actuator piston disc separating said cylinder volume in a first part and a second part and being displaceable back and forth in the axial direction in said cylinder volume between an inactive position and an active position, the first part of the cylinder volume being configured for controllable fluid communication with said pressure fluid source and said pressure fluid sink, respectively, the actuator piston being biased in a direction from the second part of the cylinder volume towards the first part of the cylinder volume, and a hydraulic circuit comprising a chamber, a free end of the actuator piston rod being disposed in said chamber, wherein the actuator piston rod is displaceable back and forth in the axial direction in a channel in connection with axial displacement of the actuator piston disc in the cylinder volume, said channel extending between the first part of the cylinder volume and the chamber of the hydraulic circuit, and wherein said channel comprises at least one circumferential ventilation groove that is constantly connected to said pressure fluid sink.

* * * * *